US009580989B2

(12) United States Patent
Halfmann et al.

(10) Patent No.: US 9,580,989 B2
(45) Date of Patent: Feb. 28, 2017

(54) INTERVENTIONLESS METHOD OF SETTING A CASING TO CASING ANNULAR PACKER

(71) Applicant: BAKER HUGHES INCORPORATED, Houston, TX (US)

(72) Inventors: Eric Halfmann, Magnolia, TX (US); Keven O'Connor, Houston, TX (US); Basil Jacob Joseph, Sugarland, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 266 days.

(21) Appl. No.: 14/482,651

(22) Filed: Sep. 10, 2014

(65) Prior Publication Data

US 2016/0069151 A1 Mar. 10, 2016

(51) Int. Cl.

| | |
|---|---|
| ***E21B 33/12*** | (2006.01) |
| ***E21B 33/128*** | (2006.01) |
| ***E21B 23/06*** | (2006.01) |

(52) U.S. Cl.

CPC ..... *E21B 33/1208* (2013.01); *E21B 23/06* (2013.01); *E21B 33/128* (2013.01)

(58) Field of Classification Search

None

See application file for complete search history.

(56) References Cited

U.S. PATENT DOCUMENTS

| | | | | |
|---|---|---|---|---|
| 2,606,618 | A | 8/1952 | Page | |
| 2,799,348 | A | 7/1957 | Page | |
| 4,432,417 | A | 2/1984 | Bowyer | |
| 4,484,625 | A | 11/1984 | Barbee, Jr. | |
| 5,020,600 | A | 6/1991 | Coronado | |
| 2009/0308592 | A1* | 12/2009 | Mercer | E21B 23/06 166/134 |
| 2013/0133891 | A1* | 5/2013 | Getzlaf | E21B 34/12 166/308.1 |

(Continued)

FOREIGN PATENT DOCUMENTS

| | | | |
|---|---|---|---|
| GB | 2080368 | A | 2/1982 |
| WO | 2014007801 | A1 | 1/2014 |

OTHER PUBLICATIONS

Great Britain Intellectual Property Office; Office Action for Application No. GB1514066.8 dated Oct. 6, 2015.

*Primary Examiner* — Jennifer H Gay
*Assistant Examiner* — Caroline Butcher
(74) *Attorney, Agent, or Firm* — Parsons Behle & Latimer

(57) ABSTRACT

An annular packer to create an annulus seal that includes a solid mandrel with a first end, second end, central bore, and exterior. The annular packer includes first and second sealing elements connected to the exterior. The second sealing element is expanded radially by axial movement of at least a portion of the second sealing element. The annular packer includes a first piston movable from a first position to a second position. Pressure applied exterior of the mandrel moves a portion of the first sealing element away from the mandrel to create a first seal causing a pressure differential. The pressure differential moves the first piston to its second position axially moving at least a portion of the second sealing element to create a second seal against the casing. A port may be opened releasing the first seal, but the second seal remains set against the casing.

26 Claims, 8 Drawing Sheets

(56) References Cited

U.S. PATENT DOCUMENTS

| | | | | |
|---|---|---|---|---|
| 2014/0048281 | A1* | 2/2014 | Acosta | E21B 23/04 166/373 |
| 2015/0075781 | A1* | 3/2015 | Buechler | E21B 33/1208 166/250.01 |
| 2015/0292296 | A1* | 10/2015 | Ezell | E21B 23/06 166/387 |

* cited by examiner

INTERVENTIONLESS METHOD OF SETTING A CASING TO CASING ANNULAR PACKER

BACKGROUND

Field of the Disclosure

The embodiments described herein relate to an annular packer that includes a solid mandrel and may be set using annular pressure.

Description of the Related Art

Improving the safety and integrity of oilfield operations and design is a top priority in the oil and gas industry. It is important to provide an effective barrier between the downhole formation and the rig floor in order to prevent uncontrolled flow of fluids up to the wellhead. The main barrier between the formation and the rig floor is typically a cemented casing string. The cement creates a barrier in the annular space between the casing string and the formation directing the formation fluids and/or pressure into the production string where multiple devices and methods may be used to control the wellbore pressure.

In some instances, it may be necessary to provide another barrier in the annulus. Annulus packing devices are previously known to be used to create an annular seal. Annular packing devices are typically set by the application of pressure from within the bore of the device to set a packing element against the casing string. However, the flow paths required for setting the packing elements may provide additional leak paths whereby formation fluid may travel into the wellbore through the device. It may be desirable to have an annular packing device that does not include any flow paths from the bore that may be potential leak paths. Other annular packing devices may require complex setting mechanisms such as using an electronic or acoustic signal transmitted to the tool to set the packing elements. The complexity of such systems increases the costs of such annular packers. Further, such systems require an application of providing the requisite signals to the downhole location of the annular packer. It would be desirable to provide an annular packer that may be simply actuated by the application of annulus pressure.

SUMMARY

The present disclosure is directed to an annular packing device and method that overcomes some of the problems and disadvantages discussed above.

One embodiment is an annular packer comprising a solid mandrel having a first end, a second end, a central bore, and an exterior. The annular packer comprises a first sealing element connected to the exterior of the mandrel and a second sealing element connected to the exterior of the mandrel, wherein the second sealing element is expanded radially by axial movement of at least a portion of the second sealing element. The annular packer comprises a first piston movable from a first position to a second position within a first chamber on the exterior of the mandrel, the first piston and first chamber being positioned between the first sealing element and the second sealing element. A pressure differential exterior of the mandrel moves the first piston from the first position to the second position and the movement of the first piston to the second position axially moves at least a portion of the second sealing element.

An application of pressure around the exterior of the mandrel may move a portion of the first sealing element away from the exterior of the mandrel to create a first seal against a casing and the radial expansion by axial movement of at least a portion of the second sealing element creates a second seal against the casing. The first seal may cause a pressure differential. The annular packer may include a cone connected to the exterior of the mandrel adjacent to the second sealing element, the cone may be positioned between the first piston and the second sealing element and the movement of the first piston to the second position may move at least a portion of the cone between a portion of the second sealing element and the exterior of the mandrel.

The annular packer may include an equalization port. The equalization port may be closed when the first piston is in its first position and may be open when the first piston is in its second position. The first seal may be released when the equalization port is open. The annular packer may include a spring that biases the first sealing element to move away from the casing towards the exterior of the mandrel. The second seal may remain set against the casing during and after when the equalization port is opened. The annular packer may include a shearable device that selectively retains the first piston in its first position, wherein the shearable device is configured to shear and release the first piston at a predetermined pressure differential. The annular packer may include a second piston movable from a first position to a second position within a second chamber on the exterior of the mandrel. The second piston may be connected to the first piston and a pressure differential may move the second piston from its first position to its second position. The solid mandrel may comprise a single opening, the single opening being the central bore, the central bore may extend from the first end to the second end along a longitudinal axis of the solid mandrel.

One embodiment is an annular packer comprising a solid mandrel having a first end, a second end, a central bore, and an exterior. The annular packer comprises a first sealing element connected to the exterior of the mandrel and a second sealing element connected to the exterior of the mandrel, wherein the second sealing element is radially expanded by axial movement of at least a portion of the second sealing element. The annular packer includes at least one piston moveable from a first position to a second position within a chamber on the exterior of the mandrel. The at least one piston and chamber being positioned between the first sealing element and the second sealing element and the chamber including a rupture disc. A predetermined pressure differential exterior of the mandrel burst the rupture disc and moves the at least one piston from the first piston to the second position and wherein the movement of the at least one piston to the second position axially moves at least a portion of the second sealing element.

An application of pressure around the exterior of the mandrel may move a portion of the first sealing element away from the exterior of the mandrel to create an initial seal against a casing and the radial expansion of the second sealing element creates a second seal against the casing. The first seal may cause a pressure differential. The annular packer may include a cone connected to the exterior of the mandrel with the second sealing element being positioned between the first sealing element and the cone.

The annular packer may include an equalization port. The equalization port may be closed when the first piston is in its first position and may be open when the first piston is in its second position. The initial seal may be released when the equalization port is open. The annular packer may include a spring that biases the first sealing element to move away from the casing towards the exterior of the mandrel. The second seal may remain set against the casing when the equalization port is opened. The annular packer may include a plurality of pistons positioned between the second sealing element and the first sealing element. A predetermined pressure differential exterior of the mandrel bursts the rupture disc and moves the plurality of pistons to move at least a portion of the second sealing element onto at least a portion of the cone.

One embodiment is a method of sealing an annulus comprising applying pressure to an annulus between a mandrel and a casing, the mandrel being a solid mandrel having a central bore extending from a first end to a second end. The method comprises moving a portion of a first sealing element against the casing to create an initial seal, a portion of the first sealing element being connected to an exterior of the mandrel. The method comprises moving at least one piston with the pressure being applied to the annulus, the piston being slidably connected to the exterior of the mandrel. The movement of the at least one piston moves a portion of a second sealing element against the casing to create a second seal. A portion of the second sealing element being connected to the exterior of the mandrel.

The method may include opening a port to equalize the pressure and release the initial seal, wherein the second seal remains set against the casing. The movement of the at least one piston may move a cone underneath the second sealing element to move a portion of the second sealing element against the casing. The movement of the at least one piston may move a portion of the second sealing element onto a portion of a cone to move a portion of the second sealing element against the casing. The method may include increasing the pressure in the annuls after creating the initial seal and bursting a rupture disc that permits the pressure being applied to the annulus to move at least one piston. Releasing the initial seal may include moving a portion of the first sealing element away from the casing towards the exterior of the mandrel. A spring may move a portion of the first sealing element away from the casing. The method may include shearing a device prior to moving the at least one piston with pressure, wherein shearing the device releases the at least one piston.

Figure 1:
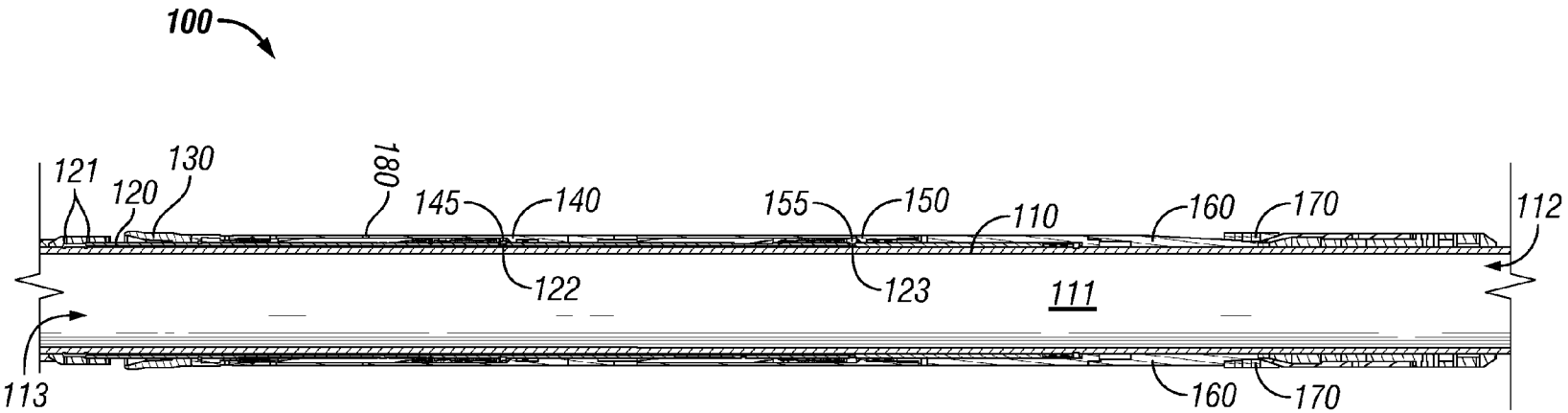
FIG. 1 shows an embodiment of an annular packer.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

Figure 2:
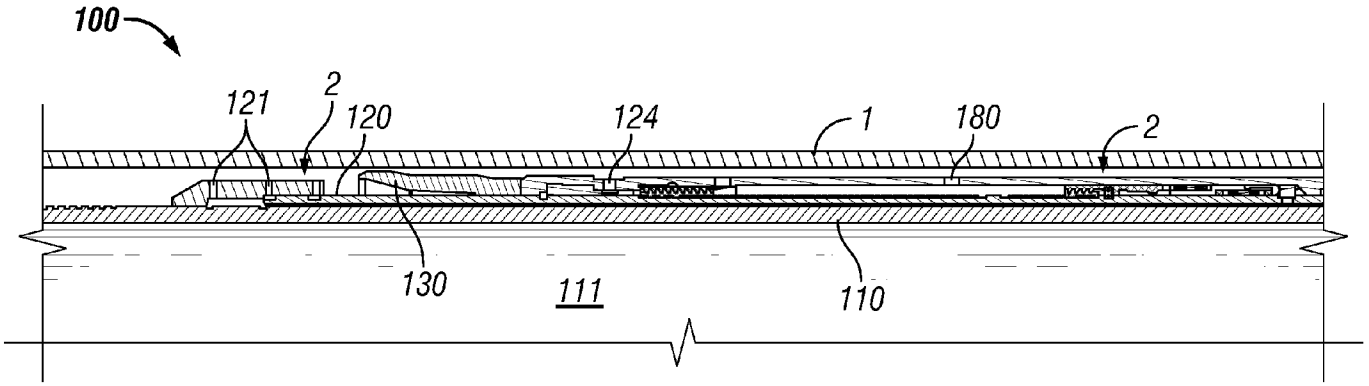
FIG. 2 shows a portion of the annular packer of FIG. 1 positioned within a wellbore.

FIG. 1 shows an embodiment of an annular packer 100 that may be used to create an annular seal within casing 1 of a wellbore (shown in FIG. 2). The annular packer 100 may be positioned within a portion of casing 1 of a wellbore such that there is an annulus 2 between the casing 1 and the annular packer 100. The annular packer comprises a solid mandrel 110 that includes a central bore 111 having an opening 112 at a lower end and an opening 113 at an upper end. The mandrel 110 is solid to the extent that body of the mandrel does not have any lateral hole or openings. In other words, the only opening in the mandrel 110 is the central bore 111 that extends along the longitudinal axis of the mandrel 110 from the opening 112 at the lower end to the opening 113 at the upper end. Annular pressure is used to actuate the annular packer 100 to create a seal between the mandrel 110 and the casing 1 as described herein.

The annular packer 100 includes at least one first sealing element 130 and at least one second sealing element 170 on the exterior of the mandrel 110. The first sealing element 130 may be various sealing elements that may be actuated by annular pressure to move away from the mandrel 110 to engage the casing 1 to create an initial seal. One example of such a first sealing element is a packer cup. The first sealing element 130 will hereinafter be referred to as a packer cup, but may be various sealing elements as would be appreciated by one of ordinary skill in the art having the benefit of this disclosure. The second sealing element 170 may be various sealing elements. For example, the mechanically actuated sealing element may be radially expanded against the casing due to axial movement of a portion and/or components of the sealing element. The second sealing element 170 may be a sealing element that may be expanded radially due to movement along a cone 160 as described herein.

The packer cup 130 will create a first or an initial seal with the casing 1 (shown in FIG. 2) blocking flow through the annulus 2 (shown in FIG. 2) and, thus causing sealing element 170 to be set against the casing 1 creating the primary seal as described herein. Positioned between the packer cup 130 and the sealing element 170 are a plurality of pistons 140 and 150 and a cone 170. The pistons 140 and 150 are positioned within respective piston chambers 145 and 155 along the exterior of the mandrel 110. Annulus pressure on the pistons 140 and 150 causes the movement of the pistons 140 and 150 within the chambers 145 and 155, which causes the movement of the cone 160 underneath the sealing element 170. As the sealing element 170 travels up the angled surface of the cone 160 it will expand outwards away from the exterior surface of the mandrel 110 until it engages the inner surface of the casing 1 creating a seal within the annulus 2. The number, location, and configuration of the pistons 140 and 150 are for illustrative purposes only and may be varied and still actuate the sealing element 170 as would be appreciated by one of ordinary skill in the art having the benefit of this disclosure.

The annulus packer 100 may include a sleeve 120 connected to the exterior of the mandrel 110 that provides a flow path to the piston chambers 145 and 155 when the packer cup 130 engages the casing 1 preventing the flow of fluid down the annulus 2 past the packer cup 130. Ports 121 permit the flow of fluid behind the sleeve 120 to actuate the pistons 140 and 150. Ports 122 and 123 in the sleeve 120 permit the flow of fluid into the piston chambers 145 and 155 to actuate the pistons 140 and 150 via annulus pressure. An equalization port 180 permits the equalization of pressure across the packer cup 130 after the setting of the sealing element 170 as discussed herein.

Figure 3:
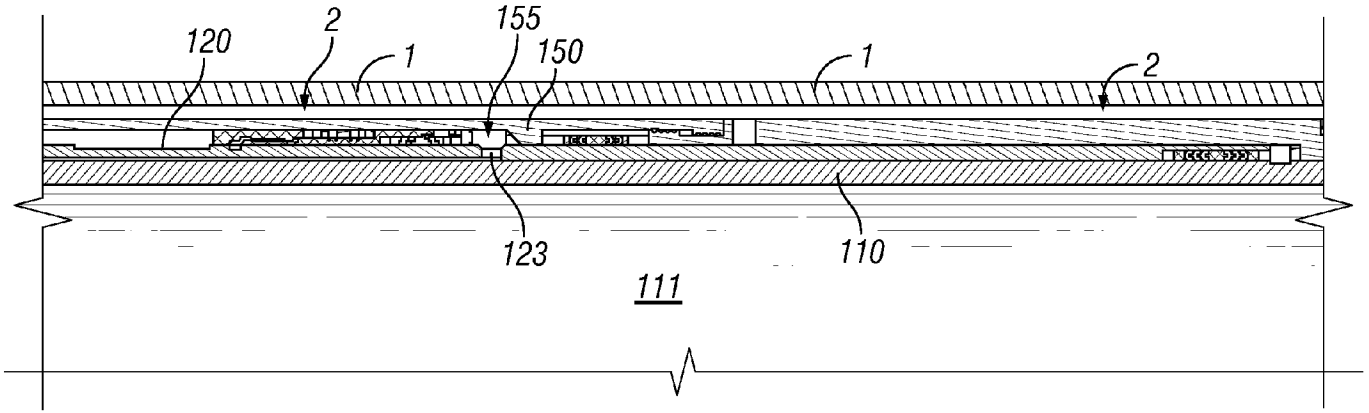
FIG. 3 shows a portion of the annular packer of FIG. 1 positioned within a wellbore.

FIGS. 2 and 3 show close-up views of portions of the tool 100 in a run-in position. As the tool 100 is run into the wellbore fluid is circulated down the bore 111 of the mandrel 110. The pressure annulus pressure above and below the pistons 140 and 150 is balanced as the packer cup 130 is not engaged with the casing 1 of the wellbore permitting fluid flow in the annulus 2 past the packer cup 130. Shear pin 124 selectively retains the pistons 140 and 150 in their initial run-in position. In the run-in position, fluid may enter behind the sleeve 120 connected to the exterior of the mandrel 110 via ports 121, however, the gap between the packer cup 130 and casing 1 permits the pressure to be balanced above and below the pistons 140 and 150. FIG. 3 shows a close-up view of piston 150 and piston chamber 155 in the initial run-in position. Fluid may enter the piston chamber 155 from behind the sleeve 120 via port 123.

Figure 4:
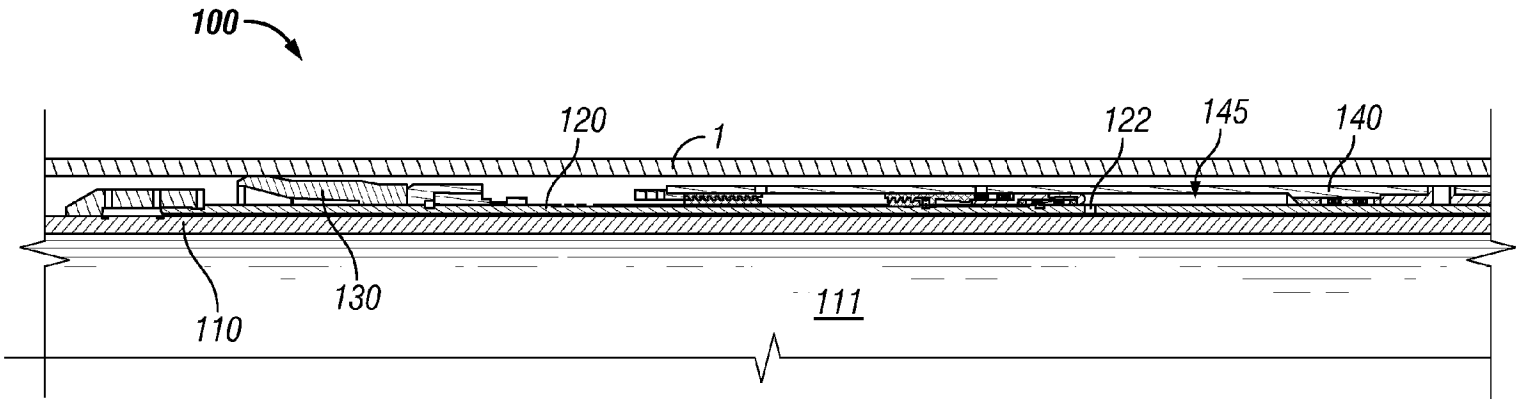
FIG. 4 shows a portion of the annular packer of FIG. 1 positioned within a wellbore.
Figure 5:
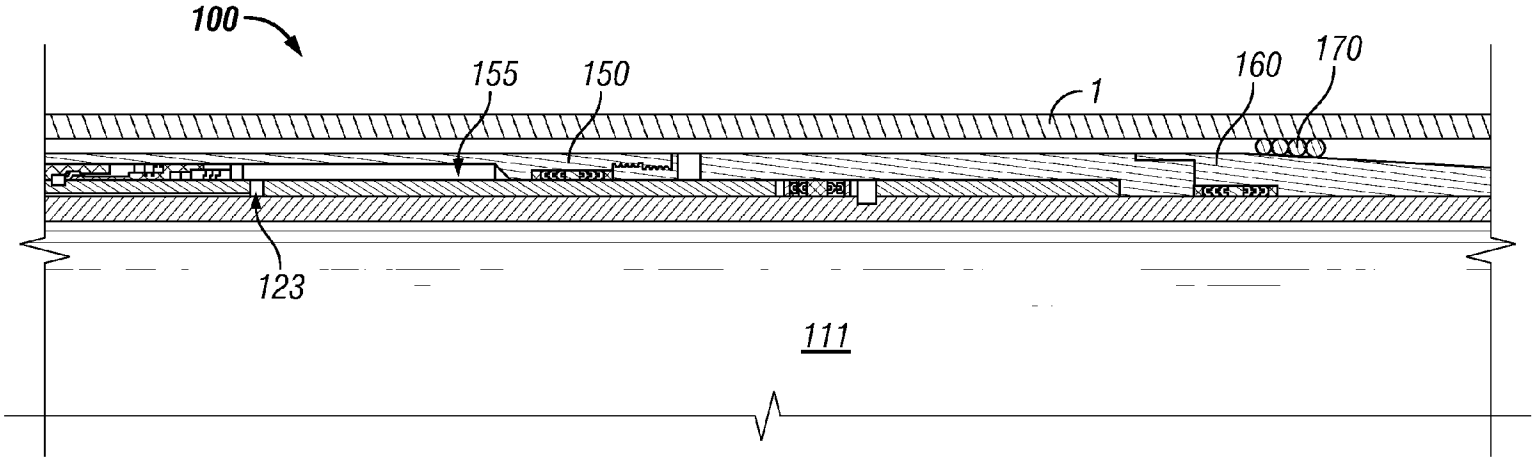
FIG. 5 shows a portion of the annular packer of FIG. 1 positioned within a wellbore.
Figure 6:
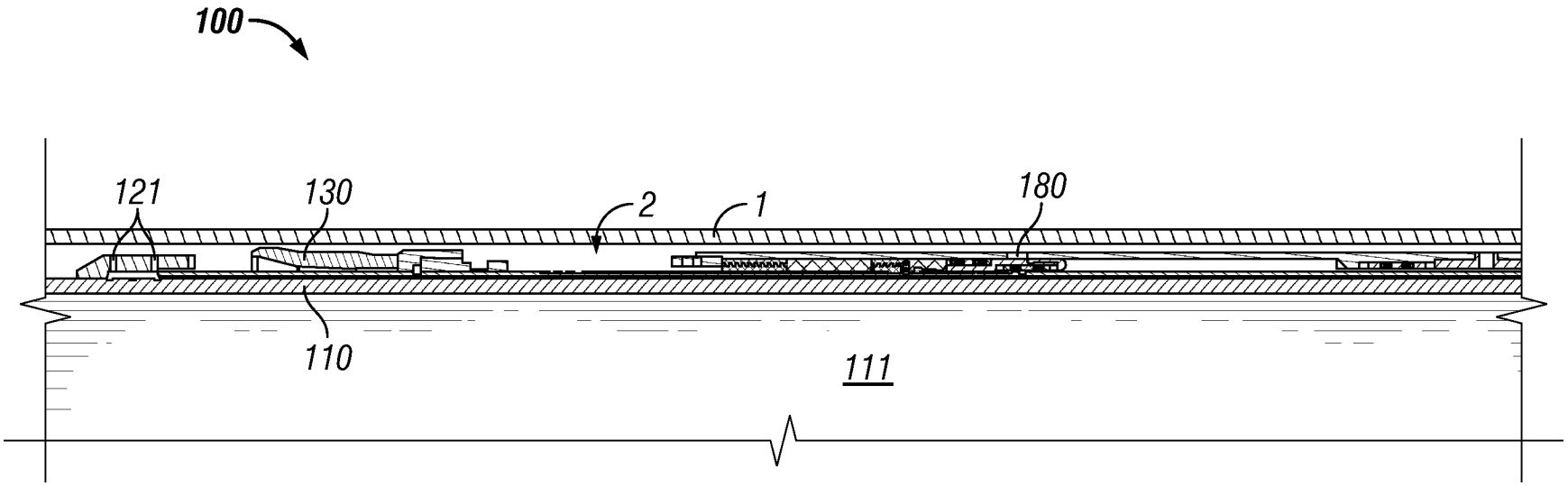
FIG. 6 shows a portion of the annular packer of FIG. 1 positioned within a wellbore.

FIGS. 4 and 5 show close-up views of portions of the tool 100 in a set position. Once the tool 100 is located in a desired portion of the casing 1 in which to create an annular seal, annular pressure is applied to the annulus 2 between the mandrel 110 and the casing 1. The annular pressure causes the packer cup 130 to extend away from the mandrel 110 and engage the casing 1 creating an initial seal. The initial seal created by the packer cup 130 prevents flow down the annulus 2 past the packer cup 130 and thus, the pressure above and below the pistons 140 and 150 is no longer balanced. Fluid pressure in the annulus 2 enters behind the sleeve 120 on the exterior of the mandrel 110 via ports 121. The fluidic pressure behind the sleeve 120 enters piston chamber 145 via port 122 and piston chamber 155 via port 123. The pressure inside the chambers 145 and 155 will increase until at a predetermined pressure the shear pin 124 (shown in FIG. 2) shears releasing pistons 140 and 150. The annular pressure applied to the piston chamber 145 and 155 pushes the pistons 140 and 150 down along the exterior of the mandrel 110. The movement of the pistons 140 and 150 pushes the cone 160 underneath sealing element 170 until a seal is created with the sealing element 170 between the cone 160 and the casing 1 as shown in FIG. 5. The sealing element 170 creates the primary annular seal with the casing 1.

The movement of the pistons 140 and 150 also uncover equalization port 180 after setting the primary seal 170 in the annulus. Equalization port 180 permits the equalization of pressure above and below the packer cup 130, which releases the initial seal set by the packer cup 130 against the casing 1. The primary annular seal between the tool 100 and the casing 1 that is created by the sealing element 170 and cone 160 remains set even upon equalization of pressure above and below the packer cup 130. The tool 100 shown in FIGS. 1-6 is one embodiment that permits providing an annular seal by the application of annular pressure with a tool 100 that has a solid mandrel 110.

Figure 7:
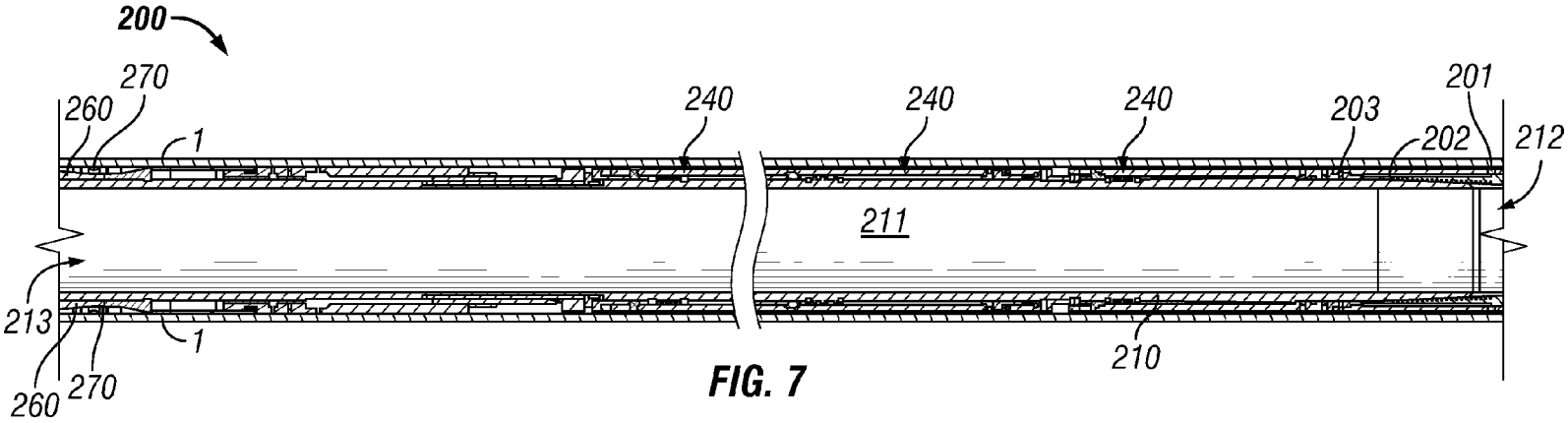
FIG. 7 shows an embodiment of an annular packer.

FIG. 7 shows an upper portion of an embodiment of an annular packer 200 that may be used to create an annular seal within casing 1 of a wellbore. The annular packer 200 may be positioned within a portion of casing 1 of a wellbore such that there is an annulus 2 between the casing 1 and the annular packer 200. The annular packer comprises a solid mandrel 210 that includes a central bore 211 having an opening 212 at a lower end and an opening 213 at an upper end. The mandrel 210 is solid to the extent that body of the mandrel does not have any lateral hole or openings. In other words, the only opening in the mandrel 210 is the central bore 211 that extends along the longitudinal axis of the mandrel 210 from the opening 212 at the lower end to the opening 213 at the upper end. Annular pressure is used to actuate the annular packer 200 to create a seal between the mandrel 210 and the casing 1 as described herein.

The exterior of the mandrel 210 includes a plurality of pistons 240 that may be actuated to move a sealing element 270 along a cone 260 to sealingly engage with the casing 1 as described herein. A rupture disc 201 on the exterior of the mandrel 210 selectively permits pressure from actuating the pistons 240 to create the annular seal until a predetermined pressure is reached in the annulus 2 between the casing 1 and the annular packer 200. A flow path 202 fluidly connects the rupture disc 201 with the plurality of pistons 240 on the exterior of the mandrel 210. A shear pin 203 prevents the premature movement of the pistons 240 along the exterior of the mandrel 210 until acted upon by annular pressure through the burst ruptured disc and flow path 202.

Figure 8:
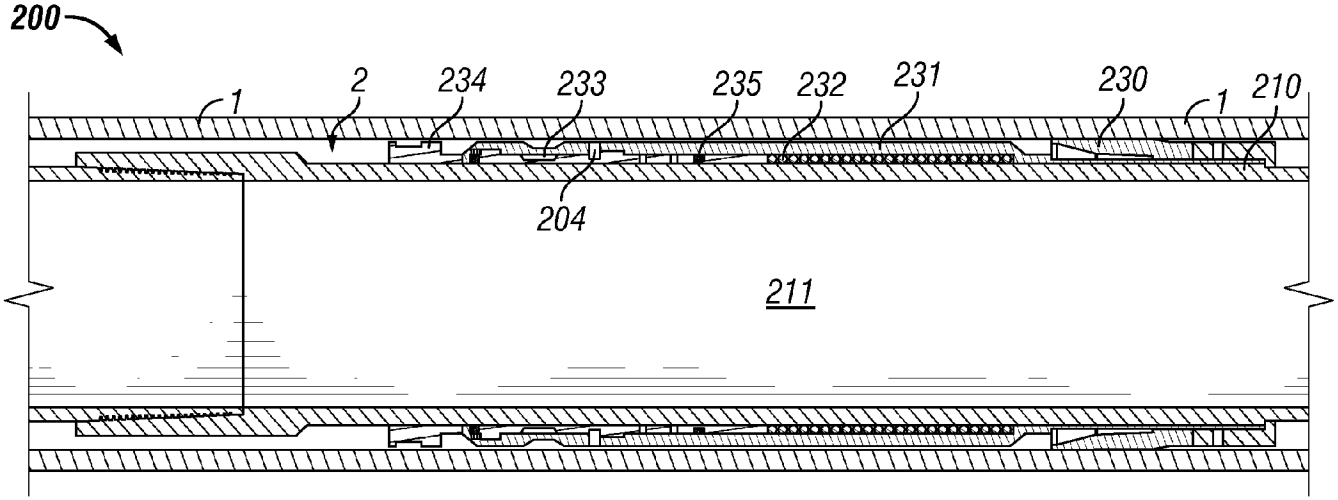
FIG. 8 shows a portion of the annular packer of FIG. 7 positioned within a wellbore.

FIG. 8 shows a lower portion of the annular packer 200 that may be used to create an annular seal within the annulus 2 between the casing 1 and the annular packer 200. The lower portion of the packer 200 includes a packer cup 230 that is configured to engage the casing 1 when annulus pressure is applied to the packer 200. The annular pressure causes the packer cup 230 to move away from the exterior of the mandrel 210 and engage the inner diameter of the casing to create an initial seal in the annulus preventing fluid to flow down the annulus past the packer cup 230. Adjacent to the packer cup 230 is a spring 232 positioned within a spring housing 231. A seal 235 with the spring housing 231 prevents fluid from flowing past the inside of the packer cup 230. As discussed herein, the removal of the seal 235 off the sealing surface within the spring housing 231 after the setting of annular sealing element 260 permits the pressure to be balanced across the packer cup 230. A spring piston 234 is connected to the spring 232 that will move downhole and compress the spring 232 within the spring housing 231 when the annular pressure is increased to a predetermined pressure amount. A shear pin 204 prevents the premature movement of the spring piston 234 until the annular pressure reaches the predetermined amount. The spring housing 231 includes a c-ring 233 configured to capture a portion of the spring piston 234 after the annular seal 270 has been set, as discussed herein. The capturing of the spring piston 234 by the c-ring 233 moves the seal 235 off the sealing surface permitting a pressure balance across the packer cup 230 and releasing the initial seal with the casing 1.

Figure 9:
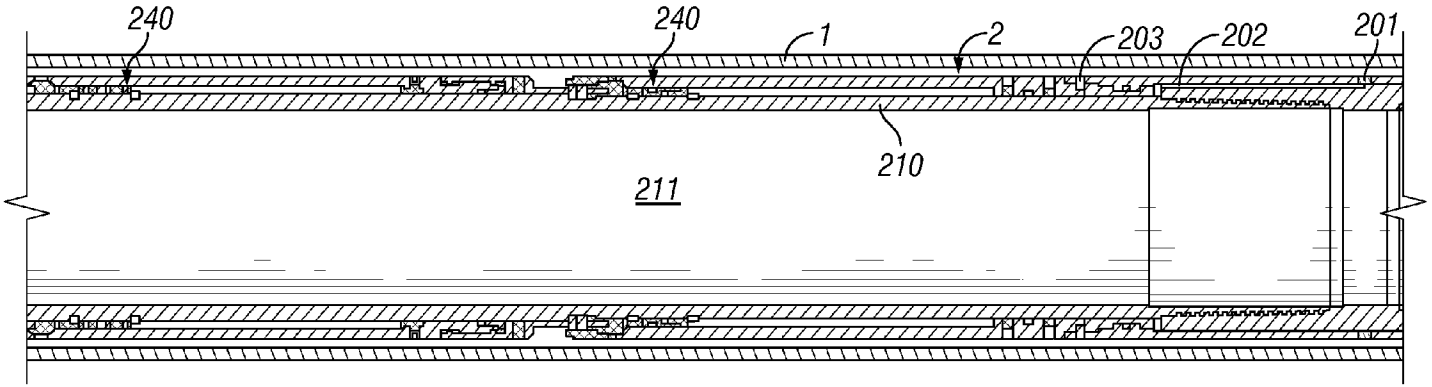
FIG. 9 shows a portion of the annular packer of FIG. 7 positioned within a wellbore.
Figure 10:
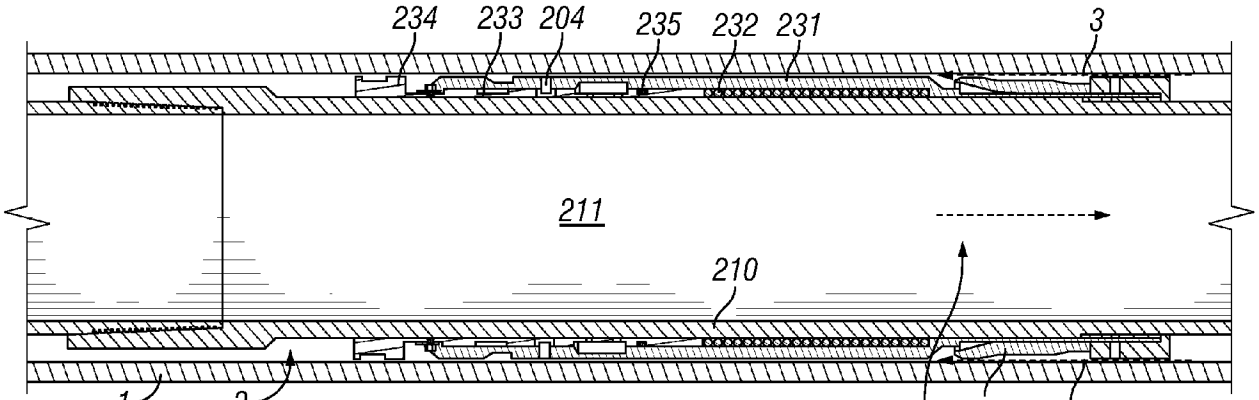
FIG. 10 shows a portion of the annular packer of FIG. 7 positioned within a wellbore.

FIG. 9 shows an upper portion of the annular packer 200 in a run-in position. The rupture disc 201 has not yet burst and as the pistons 240 are retained in their initial positions by shear pin 203. Fluid pressure is balanced on both the central bore 211 of the annular packer 200 as well as in the annulus 2 between the casing 1 and the mandrel 210. FIG. 10 shows a lower portion of the annular packer 200 in a run-in position as the packer cup 230 is not yet engaged with the casing 1 permitting the pressures to be balanced in the annulus 2 and central bore 211 as indicated by circulating flow in the bore 211 represented by arrow 214 and circulating flow in the annulus represented by arrows 3. Shear pin 204 retains the spring piston 234 in its initial position with seal 235 being engaged on a sealing surface.

Figure 12:
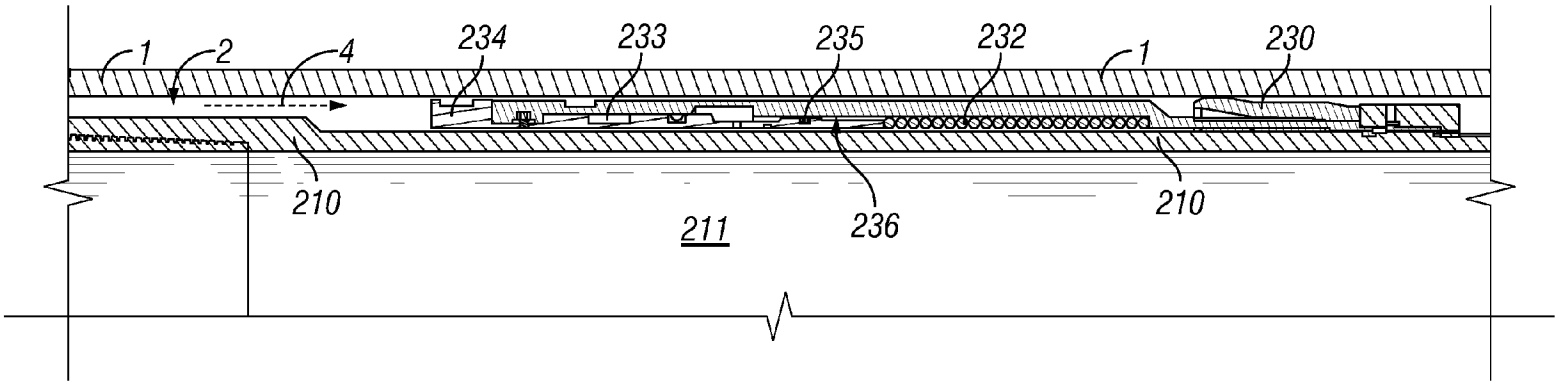
FIG. 12 shows a portion of the annular packer of FIG. 7 positioned within a wellbore.

FIG. 12 shows the lower portion of the annular packer 200 with an annular pressure applied to create an initial seal between the packer cup 230 and the casing 1 in the annular. Fluid pumped down the annulus as represented by arrow 4 will increase the annulus pressure pushing spring piston 234 downhole so a portion is moved within spring housing 231 compressing spring 232 within the housing 231. Seal 235 engages sealing surface 236 preventing flow past the back side of the packer cup 230. The c-ring 233 will capture a portion of the spring piston 234 when it is biased uphole after the setting of the annular seal 270 as discussed in regards to FIG. 13.

Figure 11:
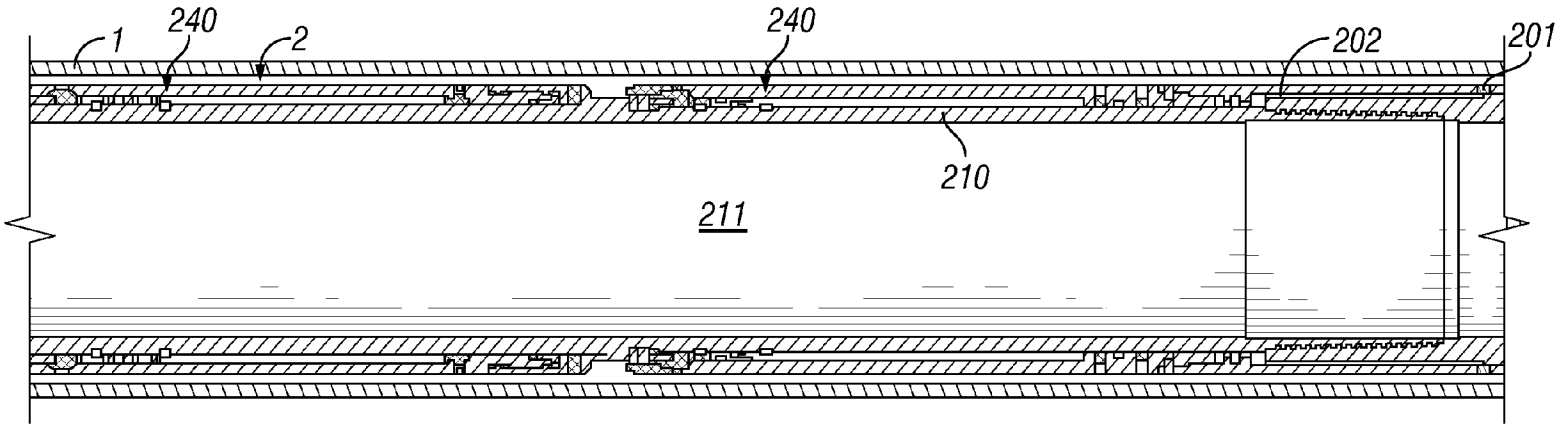
FIG. 11 shows a portion of the annular packer of FIG. 7 positioned within a wellbore.

The pumping of fluid down the annulus 2 will continue to increase annular pressure until rupture disc 201 bursts as shown in FIG. 11. Fluid will then travel down flow path 202 until the applied pressure shears shear pin 203 (shown in FIG. 9) releasing the pistons 240. The flow pressure applied through path 202 with move the pistons 240 uphole causing annular seal 270 to travel up cone 260 creating an annular seal against the casing 1 as shown in FIG. 7.

Figure 13:
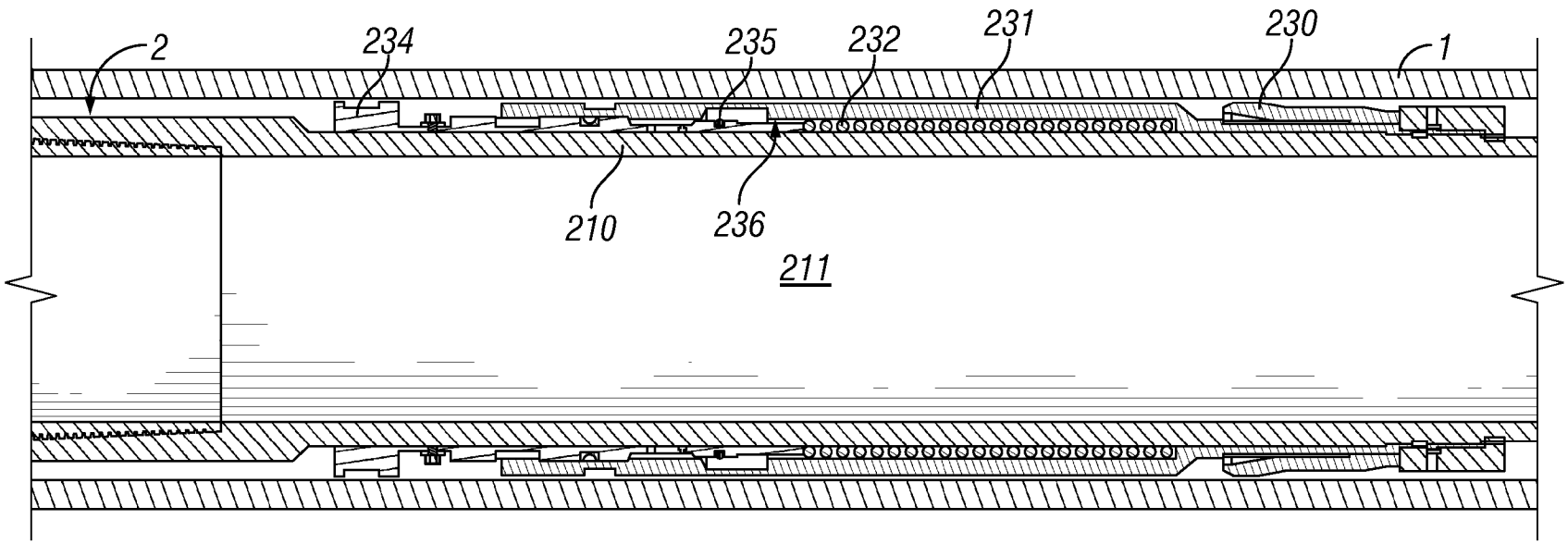
FIG. 13 shows a portion of the annular packer of FIG. 7 positioned within a wellbore.

After the annular seal is set, the spring 232 will push the spring piston 234 away from the end of the spring housing 231. As the spring piston 234 travels within the housing 231, c-ring 233 captures a portion of the spring piston 234 moving the seal 235 off sealing surface 236 as shown in FIG. 13. The seal 235 no longer prevents fluid flow along the back side of packer cup 230 between the mandrel 210 and the packer cup 230 balancing the pressure above and below the packer cup 230. Thus, the packer cup 230 moves away from the casing 1 removing the initial annular seal. However, the primary annular seal between the casing 1 and sealing element 270 remains set. The tool 200 shown in FIGS. 7-13 is one embodiment that permits providing an annular seal by the application of annular pressure with a tool 200 that has a solid mandrel 210.

Although this invention has been described in terms of certain preferred embodiments, other embodiments that are apparent to those of ordinary skill in the art, including embodiments that do not provide all of the features and advantages set forth herein, are also within the scope of this invention. Accordingly, the scope of the present invention is defined only by reference to the appended claims and equivalents thereof.

What is claimed is:

1. An annular packer comprising:

a solid mandrel having a first end, a second end, a central bore, and an exterior;

a first sealing element connected to the exterior of the mandrel;

a second sealing element connected to the exterior of the mandrel, wherein the second sealing element is expanded radially by axial movement of at least a portion of the second sealing element;

a first piston movable from a first position to a second position within a first chamber on the exterior of the mandrel, the first piston and first chamber being positioned between the first sealing element and the second sealing element; and a first port that permits fluid flow into the first chamber, wherein the first sealing element is between the first port and the second sealing element;

wherein via the first port, a pressure differential exterior of the mandrel moves the first piston from the first position to the second position and wherein the movement of the first piston to the second position axially moves at least the portion of the second sealing element.

2. The annular packer of claim 1, wherein an application of pressure around the exterior of the mandrel moves a portion of the first sealing element away from the exterior of the mandrel to create a first seal against a casing and the radial expansion by axial movement of at least the portion of the second sealing element creates a second seal against the casing.

3. The annular packer of claim 2, wherein the first seal causes the pressure differential.

4. The annular packer of claim 3, further comprising a cone connected to the exterior of the mandrel adjacent to the second sealing element, the cone being positioned between the first piston and the second sealing element and wherein the movement of the first piston to the second position moves at least a portion of the cone between at least a portion of the second sealing element and the exterior of the mandrel.

5. The annular packer of claim 3, further comprising an equalization port, the equalization port being closed when the first piston is in the first position and being open when the first piston is in the second position, wherein the opening of the equalization port releases the first seal.

6. The annular packer of claim 5, wherein a spring biases the first sealing element to move away from the casing towards the exterior of the mandrel.

7. The annular packer of claim 5, wherein the second seal against the casing remains during and after when the equalization port is opened.

8. The annular packer of claim 2, further comprising a shearable device that selectively retains the first piston in the first position, wherein the shearable device is configured to shear and release the first piston at a predetermined pressure differential.

9. The annular packer of claim 8, further comprising a second piston movable from a first position to a second position within a second chamber on the exterior of the mandrel, the second piston being connected to the first piston, wherein the pressure differential moves the second piston from the first position to the second position.

10. The annular packer of claim 2, wherein the solid mandrel further comprises a single opening, the single opening being the central bore, the central bore extending from the first end to the second end along a longitudinal axis of the solid mandrel.

11. An annular packer comprising:

a solid mandrel having a first end, a second end, a central bore, and an exterior;

a first sealing element connected to the exterior of the mandrel;

a second sealing element connected to the exterior of the mandrel, wherein the second sealing element is radially expanded by axial movement of at least a portion of the second sealing element;

at least one piston movable from a first position to a second position within a chamber on the exterior of the mandrel, the at least one piston and chamber being positioned between the first sealing element and the second sealing element;

a first port that permits fluid flow into the chamber, wherein the first sealing element is between the first port and the second sealing element;

a rupture disc in communication with the chamber and the first port that selectively prevents communication from the first port to the chamber;

wherein via the first port, a predetermined pressure differential exterior of the mandrel bursts the rupture disc and moves the at least one piston from the first position to the second position and wherein the movement of the at least one piston to the second position axially moves at least the portion of the second sealing element.

12. The annular packer of claim 11, wherein an application of pressure around the exterior of the mandrel moves a portion of the first sealing element away from the exterior of the mandrel to create an initial seal against a casing and the radial expansion of the second sealing element creates a second seal against the casing.

13. The annular packer of claim 12, wherein the initial seal causes the pressure differential.

14. The annular packer of claim 13, further comprising a cone connected to the exterior of the mandrel, the second sealing element being positioned between the first sealing element and the cone.

15. The annular packer of claim 14, further comprising an equalization port, the equalization port being closed when the first piston is in the first position and being open when the first piston is in the second position, wherein the opening of the equalization port releases the initial seal.

16. The annular packer of claim 15, wherein a spring biases the first sealing element to move away from the casing towards the exterior of the mandrel.

17. The annular packer of claim 15, wherein the second seal against the casing remains when the equalization port is opened.

18. The annular packer of claim 14, further comprising a plurality of pistons positioned between the second sealing element and the first sealing element, wherein the predetermined pressure differential exterior of the mandrel bursts the rupture disc and moves the plurality of pistons to move at least a portion of the second sealing element onto at least the portion of the cone.

19. The method of claim 18, further comprising shearing a device prior to moving the at least one piston with the pressure, wherein shearing the device releases the at least one piston.

20. A method of sealing an annulus comprising:

applying pressure to an annulus between a mandrel and a casing, the mandrel being a solid mandrel having a central bore extending from a first end to a second end;

moving a portion of a first sealing element against the casing to create an initial seal to selectively isolate the annulus below the first sealing element from the pressure being applied to the annulus, a portion of the first sealing element being connected to an exterior of the mandrel;

flowing fluid from the annulus above the first sealing element into a chamber below the first sealing element via a port;

moving at least one piston within the chamber with the pressure being applied to the annulus above the first sealing element via the port, the piston being slidably connected to the exterior of the mandrel; and wherein movement of the least one piston moves a portion of a second sealing element against the casing to create a second seal, a portion of the second sealing element being connected to the exterior of the mandrel.

21. The method of claim 20, further comprising opening an equalization port to equalize the pressure and releasing the initial seal, wherein the second seal remains set against the casing.

22. The method of claim 21, further comprising increasing the pressure in the annulus after creating the initial seal and bursting a rupture disc that permits the pressure being applied to the annulus above the first sealing element to move the at least one piston.

23. The method of claim 21, wherein releasing the initial seal further comprises moving the portion of the first sealing element away from the casing towards the exterior of the mandrel.

24. The method of claim 23, wherein a spring moves the portion of the first sealing element away from the casing.

25. The method of claim 20, wherein the movement of the at least one piston moves a cone underneath the second sealing element to move the portion of the second sealing element against the casing.

26. The method of claim 20, wherein the movement of the at least one piston moves the second sealing element onto a portion of a cone to move the portion of the second sealing element against the casing.

* * * * *